US007316132B2

(12) United States Patent
Shimasaki

(10) Patent No.: US 7,316,132 B2
(45) Date of Patent: Jan. 8, 2008

(54) KNITTING METHOD FOR WIDE RIB TEXTURE BY PLATING

(75) Inventor: Yoshinori Shimasaki, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/587,838

(22) PCT Filed: Jan. 27, 2005

(86) PCT No.: PCT/JP2005/001063

§ 371 (c)(1),
(2), (4) Date: Jul. 28, 2006

(87) PCT Pub. No.: WO2005/073445

PCT Pub. Date: Aug. 11, 2005

(65) Prior Publication Data

US 2007/0169517 A1 Jul. 26, 2007

(30) Foreign Application Priority Data

Jan. 30, 2004 (JP) ..... 2004-024771

(51) Int. Cl.
*D04B 7/04* (2006.01)

(52) U.S. Cl. ..... 66/64; 66/176

(58) Field of Classification Search ..... 66/64, 66/70, 60 R, 176, 69
See application file for complete search history.

(56) References Cited

U.S. PATENT DOCUMENTS 2,379,649 A * 7/1945 Nebel ..... 66/169 R
6,021,650 A 2/2000 Okuno et al.
6,668,594 B2 12/2003 Okuno
6,766,666 B2 * 7/2004 Okamoto ..... 66/64

FOREIGN PATENT DOCUMENTS

JP 3121283 B2 12/2000
WO WO 01/64988 A1 9/2001

* cited by examiner

*Primary Examiner*—Danny Worrell
(74) *Attorney, Agent, or Firm*—Rothwell, Figg, Ernst & Manbeck, P.C.

(57) ABSTRACT

The present invention provides a knitting method that when a knitted fabric having a wide rib structure formed by the plating using a front knitting yarn and a back knitting yarn different in color from each other, in particular, using a flat knitting machine, can make less noticeable a blur of the knitted fabric at an end of the knitting width to thereby produce a good looking wide rib structure.

Using a flat knitting machine, a front stitch of the rib structure of one knitted fabric at an end of a knitted width thereof on the side on which the crossing of the knitting yarns used for the plating occurs is formed as a front stitch on the edge, and a back stitch of the rib structure of the other knitted fabric on that side is formed as a back stitch on the edge. After the front stitch of the rib structure of the one knitted fabric is knitted, the back stitch of the rib structure of the other knitted fabric is knitted changing a knitting direction, whereby the crossing is located in a crossover portion of the wide rib and thereby the blur of the knitting yarns is made less noticeable.

2 Claims, 2 Drawing Sheets

KNITTING METHOD FOR WIDE RIB TEXTURE BY PLATING

CROSS REFERENCE TO RELATED APPLICATION

This application is a 35 USC § 371 National Phase Entry Application from PCT/JP2005/001063, filed Jan. 27, 2005, and designating the United States.

TECHNICAL FIELD

The present invention relates to a knitting method for knitting a wide rib structure by plating using a flat knitting machine.

BACKGROUND ART

The plating is a knitting technique of knitting a knitted fabric in such a manner that a front yarn and a back yarn are both fed to knitting needles so that the front yarn can come to the front side of the front stitch formed and also the back yarn can come to the back side (the reverse side) of the front stitch so that the back yarn can be enfolded by the front yarn. The back yarn comes to the front side of back stitch formed and also the front yarn is hidden behind the back side (the reverse side) thereof. Due to this, the plating requires that the back yarn be located nearer to a hook side than the front yarn. For this, the plating is carried out, for example, by using both a front-yarn yarn feeder and a back-yarn yarn feeder and driving them in such a timed sequence that the front-yarn yarn feeder is driven ahead of the back-yarn feeder, or by using a yarn feeding device having two yarn feeders different in position and level or by using a yarn feeder capable of turning in response to change in a traveling direction of a carriage (cf. International Publication Pamphlet of International Publication No. WO01/064988, for example). The plating is also used for producing a reversible knitted fabric.

However, this conventional plating involves the following problems when a tubular knitted fabric, such as knitwear of a wide rib structure whose front and back knitted fabrics are joined to each other at lateral sides thereof and in which a number of front stitches and back stitches come out alternately by the plating, is knitted using a flat knitting machine. It is to be noted that the term of "the tubular knitted fabric" used in this specification is intended to cover not only a complete tubular knitted fabric extending continuously over the entire knitting width, but also a C-shaped tubular knitted fabric or a separated tubular knitted fabric, like a cardigan.

Japanese Patent Gazette of Patent No. 3121283 refers to a crossing of the knitting yarns which occurs when the tubular knitted fabric is knitted by a 2-system knitting using two yarn feeders. The same is true of the case where the tubular knitted fabric is knitted by the plating. In the plating, the front yarn must be always fed to the needles ahead of the back yarn, but in the flat knitting machine, the yarn feeders are reversed in knitting direction at opposite ends of the knitting width of the tubular knitted fabric, so that the crossing of the front yarn and the back yarn occurs at any one end of the knitting width. When the next stitch is formed in the state of the front yarn and the back yarn being reversed in position for a moment by the crossing, the yarn which really should not come out comes to the front side, causing blur (color mixing) of the knitted fabric at lateral ends thereof and thus reducing the commercial value of the knitwear. In the plating using the flat knitting machine, such a crossing of the knitting yarns cannot be avoided. Due to this, when the tubular knitted fabric is knitted using the flat knitting machine, the plating has been avoided so far. Irrespective of the types of yarn feeder and the number of needle beds of the flat knitting machine, the crossing occurs,

EXPLANATION OF LETTERS OR NUMERALS

Figure 1:
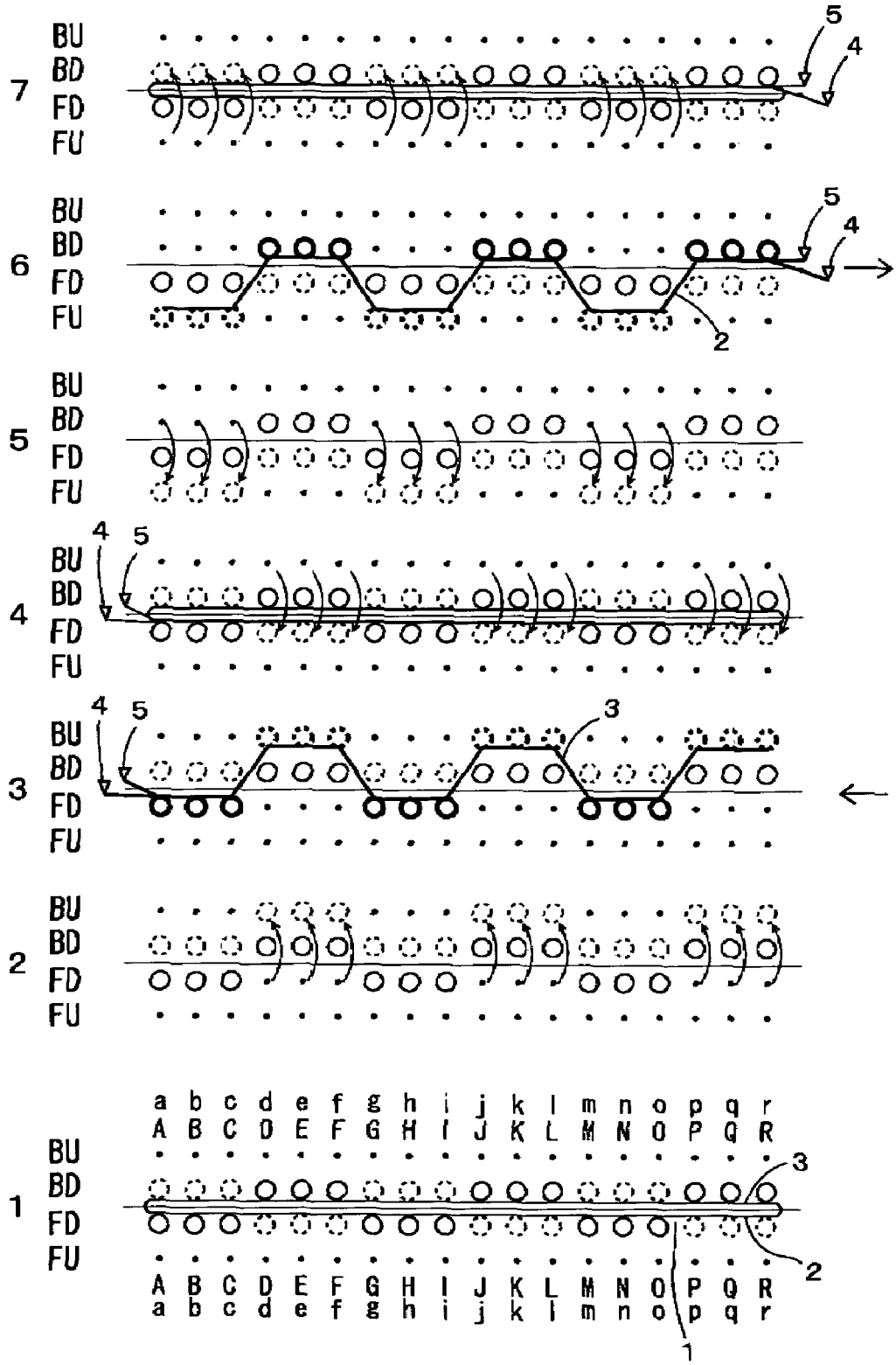
FIG. 1 is a knitting process drawing showing the processes of knitting the wide rib by the plating in the illustrated embodiment.

1 . . . Wide rib knitted fabric,
2 . . . Front knitted fabric
3 . . . Back-yarn yarn feeder,
4 . . . Front-yarn yarn feeder
5 . . . Back-yarn yarn feeder
6 . . . Crossover portion
11 . . . C-shaped knitted fabric
12 . . . Front knitted fabric
13 . . . Back knitted fabric
14 . . . Front-yarn yarn fabric
15 . . . Back-yarn yarn fabric

DISCLOSURE OF THE INVENTION

Problem to be Solved by the Invention

After having devoted themselves to make a study on the issue described above, the inventors of this application have discovered a knitting method that can make less noticeable a blur which is generated in a tubular knitted fabric having a wide rib structure at an end of the knitting width on the side thereof on which the crossing occurs when knitted by the plating using a flat knitting machine,. It is an object of the present invention to provide such a knitting method.

Means for Solving the Problem

The present invention provides a knitting-method of knitting a knitted fabric whose front knitted fabric and back knitted fabric are joined together at lateral ends of a knitting width thereof and which includes a wide rib structure formed by a plating using a flat knitting machine having at least a pair of front and back needle beds extending in a transverse direction and disposed opposite to each other in a cross direction, at least either of which is capable of being racked in the transverse direction so that loops can be transferred between the front and back needle beds, wherein a front stitch of the rib structure of one knitted fabric at an end of a knitted width thereof on the side on which the crossing of the knitting yarns used for the plating occurs is formed as a front stitch on the edge, and a back stitch of the rib structure of the other knitted fabric on that side is formed as a back stitch on the edge, and wherein after the front stitch of the rib structure of the one knitted fabric is knitted, the back stitch of the rib structure of the other knitted fabric is knitted changing a knitting direction, whereby the crossing is located in a crossover portion of the wide rib and thereby the blur of the knitting yarns is made less noticeable.

In the knitting method of the present invention, the front stitch on the edge and the back stitch on the edge are formed at the ends of the knitting width on the side on which the crossing occurs using knitting needles spaced one to three needles apart in the knitting width direction.

Effects of the Invention

In the knitting method of the present invention, the tubular knitted fabric including the wide rib structure formed by the plating is knitted using the flat knitting machine, while the crossing of the knitting yarns used for the plating is located in the crossover portion of the wide rib. From the nature of this knitted fabric, the front stitch on the edge and the back stitch on the edge are curled to each other to put the blur in the shade. Hence, the blur can be made less noticeable.

When the front stitch on the edge and the back stitch on the edge are formed at the end on the side on which the crossing occurs using knitting needles spaced one to three needles apart in the knitting width direction, a crossover yarn extending between the ribs is elongated. This can put the blur in the shade more effectively and thus can be even less noticeable.

Best Mode for Carrying Out the Invention

Next, an embodiment of the present invention is described with reference to accompanying drawings.

FIG. 1 is a knitting process drawing of a wide rib knitted fabric 1 knitted by the plating in the illustrated embodiment. The wide rib is a 3×3 rib structure comprising three front stitches (solid line) and three back stitches (broken line). In the tubular knitted fabric, the front knitted fabric 2 and the back knitted fabric 3 are joined to each other at ends thereof.

In the illustrated embodiment, a four-bed flat knitting machine comprising a pair of front lower needle bed FD and back lower needle bed BD arranged in front and back and a pair of front upper needle bed FU and back upper needle bed BU arranged over them is used. In the knitting, the knitting needles a-r of the upper needle beds and the knitting needles A-R of the lower needle beds are used. In the knitting of the wide rib knitted fabric 1, the front knitted fabric 2 is assigned to the front lower needle bed FD and the back knitted fabric 3 is assigned to the back lower needle bed BD. The front stitches of the front knitted fabric 2 are knitted on the front lower needle bed FD, and the back stitches of the front knitted fabric 2 are knitted on the back upper needle bed BU. The front stitches of the back knitted fabric 3 are knitted on the back lower needle bed BD, and the back stitches of the back knitted fabric 3 are knitted on the front upper needle bed FU. 4 designates a front-stitch yarn feeder, and 5 designates a back-stitch yarn feeder. As seen from the drawing, the yarn feeder 4 uses a track located on the side nearer than the side on which the yarn feeder 5 is located, and is moved ahead of the yarn feeder 5 to feed the yarn.

Although the four-bed flat knitting machine is used in the illustrated embodiment, a so-called two-bed flat knitting machine having a pair of front and back needle beds and capable of transferring loops between those front and back needle beds may alternatively be used. In this variant, empty needles for knitting back stitches may be arranged on the opposite needle beds so that a known half gauge knitting may be performed.

In FIG. 1, the step 1 shows the state of the front and back knitted fabrics being held on the needle beds at the completion of preparation of a course of the wide rib knitted by the plating. In the step 1, the front stitches of the front knitted fabric 2 are held on the knitting needles A-C, G-I, and M-O of the front lower needle bed FD, and the back stitches of the front knitted fabric 2 are held on the knitting needles D-F, J-L, and P-R of the front lower needle bed FD., and the front stitches of the back knitted fabric 3 are held on the knitting needles D-F, J-L, and P-R of the back lower needle bed BD, and the back stitches of the back knitted fabric 3 are held on the knitting needles A-C, G-I, and M-O of the back lower needle bed BD.

The steps 2-4 show the processes, next to the step 1, of knitting the front knitted fabric 2 leftwards as viewed in the drawing.

In the step 2, the back stitches of the front knitted fabric 2 are transferred from the needles D-F, J-L, and P-R of the front lower needle bed FD to the needles d-f, j-l, and p-r of the back upper needle bed BU.

In the step 3, a yarn feeder 4 is moved ahead of movement of a yarn feeder 5, to feed yarns to the needles, and the front stitches of the front knitted fabric 2 are knitted with the needles A-C, G-I and M-O of the front lower needle bed FD, and the back stitches of the front knitted fabric 2 are knitted with the needles d-f, j-l, and p-r of the back upper needle bed BU.

In the step 4, the back stitches of the front knitted fabric 2 are transferred from the needles d-f, j-l, and p-r of the back upper needle bed BU to the needles D-F, J-L, and P-R of the front lower needle bed FD. The yarn feeders 4, 5 are stopped at locations shown in the drawing figure, and the front yarn fed ahead from the yarn feeder 4 is located under the back yarn fed from the yarn feeder 5.

The steps 5-7 show the processes, next to the step 4, of knitting the back knitted fabric 3 rightwards as viewed in the drawing.

In the step 5, the back stitches of the back knitted fabric 3 are transferred from the needles A-C, G-I, M-O of the back lower needle bed BD to the needles a-c, g-I, and m-o of the front upper needle bed FU.

In the step 6, the yarn feeder 4 is moved ahead of movement of the yarn feeder 5, to feed the yarns to the needles, and the front stitches of the back knitted fabric 3 are knitted with the needles D-F, J-L and P-R of the back lower needle bed BD, and the back stitches of the back knitted fabric 3 are knitted with the needles a-c, g-I, and m-o of the front upper needle bed FU.

In the step 7, the back stitches of the back knitted fabric 3 are transferred from the needles a-c, g-I, and m-o of the back lower needle bed BD to the needles A-C, G-I, and M-O of the back lower needle bed BD. The yarn feeders 4, 5 are stopped at locations shown in the drawing figure, and the front yarn fed ahead from the yarn feeder 4 is located under the back yarn fed from the yarn feeder 5.

When the plating is performed, the front yarn fed from the yarn feeder 4 is required to be always fed ahead of the back yarn fed from the yarn feeder 5. Accordingly, the yarn feeder 4 is required to be reversed in direction to pass past the yarn feeder 5 from the state of the step 4 before the knitting of the step 6 starts so that in the step 6, the yarn feeder 4 can feed the front yarn to the needle a of the front upper needle bed FU ahead of the yarn feeder 5. As a result, the front yarn as was located under the back yarn in the step 4 gets over the back yarn, so that it is turned upside down on the back yarn. Then, the stitch knitted with the needle a of the front upper needle bed FU is transferred to the back lower needle bed BD in the step 7, while keeping this state intact. Thus, the crossing is genrated in a crossover portion of the wide rib which is a boundary between the front and back knitted fabrics at the left side of the drawing or a boundary between a stitch (front stitch) on the edge of the front knitted fabric 2 and a stitch (back stitch) on the edge of the back knitted fabric 3.

Thereafter, the steps 2-7 are repeated a prescribed number of times.

Similarly, the yarn feeder 4 is required to be reversed in direction to pass past the yarn feeder 5 from the state of the step 7 before the knitting of the step 3 starts so that in the step 3, the yarn feeder 4 can feed the front yarn to the needle r of the back upper needle bed BU ahead of the yarn feeder 5. However, in this knitting, the front yarn does not get over the back yarn, so that it is not turned upside down on the back yarn, differently from the step mentioned above. Thus, the crossing does not occur in the crossover portion of the wide rib in this knitting.

As described above, the crossing of the knitting yarns occurs at one end of the knitting width when the front and back knitted fabrics are joined to each other at the lateral ends of the knitting width and the wide rib structure is knitted by the plating. This causes the blur.

Figure 2:
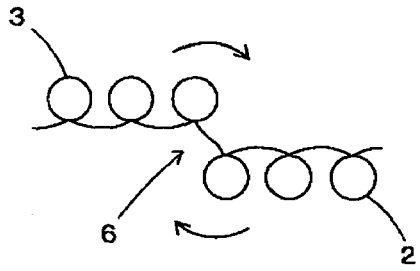
FIG. 2 is a development view showing the developed state of the left end portion of the knitted fabric of the illustrated embodiment.

FIG. 2 shows the state of the left end portion of the knitted fabric of FIG. 1 is developed to a natural state. In this embodiment, the front stitch of the rib structure of the front knitted fabric 2 is formed as the front stitch on the edge, and the back stitch of the rib structure of the back knitted fabric 3 is formed as the back stitch on the edge. Further, after the front stitch of the rib structure of the front knitted fabric 2 is knitted, the back stitch of the rib structure of the back knitted fabric 3 is knitted changing a knitting direction, whereby the crossing of the knitting yarns is located in a crossover portion 6 of the wide rib. From the nature of this knitted fabric, the front stitch on the edge and the back stitch on the edge are curled to each other to put the blur in the shade. Hence, the blur can be made less noticeable. This method is particularly effective for the knitting of the wide rib structure knitted by the plating using the front and back yarns different in color, thus producing a good-looking and highly attractive knitted fabric.

In this embodiment, the stitches on the edges of the front and back knitted fabrics at the ends thereof on the side on which the crossing of the knitting yarns occurs (in the step 1 of FIG. 1, the stitch on the needle A of the front lower needle bed FD and the stitch on the needle A of the back lower needle bed BD) correspond in position to each other. The stitch on the edge of the front knitted fabric and the stitch on the edge of the back knitted fabric may be displaced from each other by a distance corresponding to one to three stitches. This can provide an elongated crossover portion 6 in which the crossing of the knitting yarns occurs. This can put the blur generated at the ends of the knitted fabrics in the shade more effectively.

Figure 3:
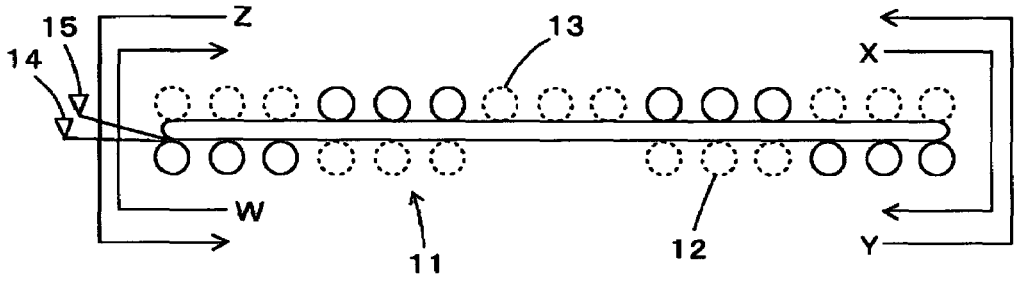
FIG. 3 is a view showing the state of a C-shaped knitted fabric being held on the needle beds for the knitting.

In this embodiment, description is given on the tubular knitted fabric whose front and back knitted fabrics are joined together completely, but the same effect can be provided for the C-shaped tubular knitted fabric 11 shown in FIG. 3 as well whose front knitted fabric 12 an back knitted fabrics 13 are joined together at the ends thereof and the front knitted fabric 12 is separated at a location in the knitting width. When the knitting is carried out along the directions W and Y by a known C-shape knitting with the needle arrangement as illustrated, a front-yarn yarn feeder 14 and a back-yarn yarn feeder 15, the crossing occurs in each crossover portion thereof, but the crossing does not occur when the knitting is carried out along the directions Z and X. Although the crossing occurs in the crossover portions at the both ends to cause the blur, since the front stitch on the edge and the back stitch on the edge are curled to each other. the blur can be made less noticeable.

In the illustrated embodiment, the plating is carried out using the two yarn feeders in the illustrated embodiment, but the plating may be carried out using a yarn feeding device having two yarn feeders different in position and level or using a yarn feeder capable of turning in response to change in a traveling direction of a carriage.

INDUSTRIAL APPLICABILITY

The knitting method of the present invention is widely applicable to the knitting of the tubular knitted fabric such as knitwear including the wide rib structure knitted by the plating.

What is claimed is:

1. A method of knitting a knitted fabric wherein a front knitted fabric and back knitted fabric are joined together at lateral ends of a knitting width thereof and which includes a wide rib structure formed by a plating using a flat knitting machine having at least a pair of front and back needle beds extending in a transverse direction and disposed opposite to each other in a cross direction, at least either of which is capable of being racked in the transverse direction so that loops can be transferred between the front and back needle beds, wherein said method comprises the steps of:

forming a front stitch of the rib structure of one knitted fabric at an end of a knitted width thereof on a side on which a crossing of the knitting yarns used for the plating occurs as a front stitch on the edge; and forming a back stitch of the rib structure of the other knitted fabric on a side on which a crossing of the knitting yarns used for the plating occurs as a back stitch on the edge; wherein after the front stitch of the rib structure of the one knitted fabric is knitted, knitting the back stitch of the rib structure of the other knitted fabric by changing a knitting direction, whereby a crossing is located in a crossover portion of the wide rib, thereby minimizing a blur of the knitting yarns.

2. The knitting method of claim 1, wherein the front stitch on the edge and the back stitch on the edge are formed at the end of the knitting width on the side on which the crossing occurs, using knitting needles spaced one to three needles apart in the knitting width direction.

* * * * *